US006905546B2

(12) United States Patent
Mainieri et al.

(10) Patent No.: US 6,905,546 B2
(45) Date of Patent: Jun. 14, 2005

(54) CONVEYOR AND POWDER PAINT COLLECTION AND METHOD

(75) Inventors: William Mainieri, Langgöns-Espa (DE); Bernd Kreuzer, Lauterbach-Maar (DE); Richard A. Cantin, Rochester Hills, MI (US); Bradley M. Hare, Warren, MI (US)

(73) Assignee: Acco Systems, Inc., Warren, MI (US)

( * ) Notice: Subject to any disclaimer, the term of this patent is extended or adjusted under 35 U.S.C. 154(b) by 0 days.

(21) Appl. No.: 10/671,050

(22) Filed: Sep. 25, 2003

(65) Prior Publication Data

US 2004/0081753 A1 Apr. 29, 2004

Related U.S. Application Data

(60) Provisional application No. 60/420,656, filed on Oct. 23, 2002.

(51) Int. Cl.[7] ..... B05C 19/00; B05B 15/12; B05B 13/02

(52) U.S. Cl. ..... 118/309; 118/324; 198/817; 198/860.3

(58) Field of Search ..... 118/308, 309, 118/326, 322, 324; 454/50, 55; 55/DIG. 46; 427/421, 424, 180; 198/817, 842, 860.3

(56) References Cited

U.S. PATENT DOCUMENTS

| | | | | | |
|---|---|---|---|---|---|
| 2,249,588 | A | * | 7/1941 | Waddle | 198/493 |
| 4,257,345 | A | * | 3/1981 | Brice | 118/634 |
| 5,296,031 | A | * | 3/1994 | Seiler et al. | 118/631 |
| 5,642,800 | A | * | 7/1997 | East | 193/37 |
| 6,550,609 | B2 | * | 4/2003 | Coen et al. | 198/842 |

* cited by examiner

*Primary Examiner*—Chris Fiorilla
*Assistant Examiner*—Yewebdar Tadesse
(74) *Attorney, Agent, or Firm*—Howard & Howard

(57) ABSTRACT

A conveyor system for a powder paint spray booth including spaced continuous parallel first and second moving belts supported by a plurality of spaced rollers enclosed within a sealed housing and a powder paint collector located below the powder paint spray booth which receives powder paint from between the sealed housings. The continuous belts are formed of stainless steel each having a width of less than ten inches and grating is provided between the housings permitting personnel to walk over the conveyor system without damaging the stainless steel belts. The collector system includes a V-shape baffle having an apex located between the conveyor housings directing powder paint into collectors on opposed sides of the conveyor units.

10 Claims, 3 Drawing Sheets

CONVEYOR AND POWDER PAINT COLLECTION AND METHOD

RELATED APPLICATIONS

This patent application claims priority to and all advantages of U.S. Provisional Patent Application No. 60/420,656 which was filed on Oct. 23, 2002.

FIELD OF THE INVENTION

The present invention relates to a conveyor and powder paint collection system and method for applying and collecting excess powder paint from a powder paint application booth, providing greater recovery of excess powder paint and reduced maintenance cost.

BACKGROUND OF THE INVENTION

The prior art includes various conveyors for conveying parts to be painted through a spray or application paint booth, including conveyors specifically designed for powder paint application booths. As used herein, the term "powder paint" is generic to any protective powder coating, including but not limited to powder paint applied by the automotive industry.

Conveyors for conveying parts through a paint booth typically include a continuous steel chain which must be lubricated to reduce wear of the chain. The parts to be conveyed are typically mounted on a skid which is conveyed through the paint booth by the chain and paint is applied to the part by paint applicators, including robotic paint applicators. Because of the wear problem with conventional steel chain and adherence of powder paint on the steel chain, particularly with the application of powder paint, stainless steel chain and sealed for life bearings have been used. However, this approach has not solved the problems associated with conveying parts through a powder paint application booth.

Another problem associated with the application of powder paint is recovery of powder paint from the paint application booth. As will be understood by those skilled in this art, a portion of any paint directed to a part to be painted by paint applicators will not be applied to the part and such paint is sometimes referred to as overspray or excess paint. The recovery of excess paint is a particular problem with powder paint. Another problem is that the powder paint adheres to most exposed surfaces, such as the belt of a conveyor. Thus, vacuum cleaners are provided at spaced locations, but the powder paint recovered by vacuum cleaners is not reusable because it generally includes contaminants.

The prior art has also proposed conveyors having a continuous stainless steel belt to reduce adherence of powder paint to the belt and the parts are conveyed on a skid received on the continuous moving stainless steel belt. Excess powder paint is then vacuumed from the belt as described above. Although the stainless steel belt is very thin, about 1 mm in thickness, the belt is about a yard in width (e.g., 38 inches), creating other problems. First, powder paint still collects on the stainless steel belt and the wide stainless steel belt is generally very expensive and easily damaged. Further, it is not possible to walk over the wide stainless steel belt, requiring workers in the powder paint application booth to continuously walk around the wide stainless steel belt for maintenance, etc. The wide stainless steel belt also interferes with the air flow through the paint application booth and thus reduces collection of excess powder paint from the booth.

There is, therefore, a longstanding need for a conveyor for powder paint application booths which solves the problems associated with the prior art described above and which also improves the airflow and efficiency of the powder collection system.

SUMMARY OF THE INVENTION

The conveyor and powder paint collection system of this invention eliminates the problems associated with the prior art conveyor and collection systems including reduced maintenance cost of the conveyor system and improved collection of the powder paint. As will be understood by those skilled in this art, the conveyor is located in the powder paint spray booth and conveys parts to be painted through the powder paint booth. The powder paint collection system is located below the powder paint booth. The conveyor of this invention includes spaced continuous parallel belts, preferably stainless steel belts, each supported by a plurality of spaced rollers. The rollers supporting the first continuous belt is enclosed within a first housing in sealed relation and the second belt is supported by a plurality of spaced rollers enclosed within a second sealed housing, spaced from the first housing. The part to be painted is supported on spaced skids which are received on the spaced continuous moving belts and the belts thus convey the part to be painted through the paint booth, which includes suitable powder paint applicators. Thus, the excess powder paint received between the sealed housings is directed to the collector located below the powder paint booth.

In the preferred embodiment, the powder paint collection system includes two powder paint collectors located on opposed sides of the first and second conveyor housings, beneath the powder paint booth, and a baffle directs the powder paint to one of the powder paint collectors. In a preferred embodiment, the baffle is V-shaped having an apex adjacent the midportion of the space between the sealed housings, directing the powder paint to one of the collectors, and the airflow through the powder paint booth is directed through grating on opposed sides of the sealed housings and a center grating is provided between the housings and supported by the housings, permitting personnel within the powder paint application booth to easily walk over the conveyor system, reducing damage to the stainless steel belts. Further, the conveyor and powder paint collection system of this invention improves circulation of air between the powder paint collection booth and the collection system, improving the collection efficiency of excess powder paint.

In a typical application, the width of each of the continuous parallel stainless steel belts is about five to seven inches wide, significantly reducing the cost of maintenance of the conveyor system, or preferably each having a width of less than ten inches. The housings preferably include a stainless steel sealed enclosure surrounding the rollers, which support the stainless steel belts and include polymeric seals which engage the peripheral edges of the belt, significantly reducing collection of excess powder paint and eliminating the requirement for sealed for life bearings. The continuous belts are received on drums or wheels, including a drive and driven wheel, for continuous movement through the powder paint application booth. Other advantages and meritorious features of this invention will be more fully understood from the following description of the preferred embodiments, the appended claims and the drawings, a brief description of which follows.

DESCRIPTION OF THE PREFERRED EMBODIMENTS

Figure 1:
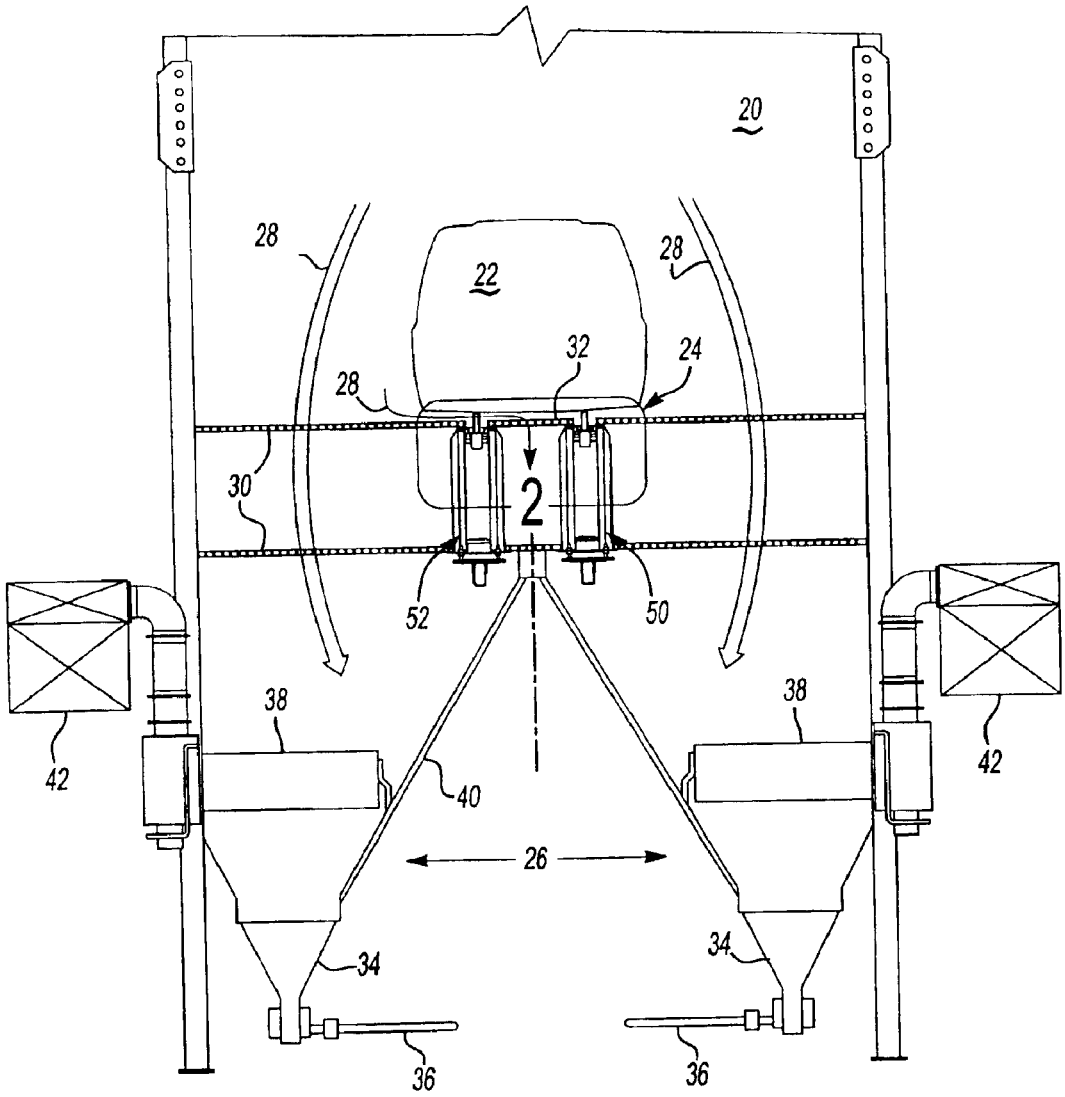
FIG. 1 is a crosssectional partially schematic view of a powder paint booth illustrating the conveyor and powder paint collection system of this invention.

FIG. 1 illustrates a powder paint spray booth 20 incorporating the conveyor and powder paint collection system of this invention. As will be understood by those skilled in this art, the powder paint spray booth 20 will include a plurality of conventional powder paint applicators (not shown) which apply powder paint to a part, such as the vehicle body 22 shown in FIG. 1. The powder paint spray booth 20 includes a conveyor system 24, described in detail hereinbelow, and a powder paint collection system 26 is located below the powder paint spray booth 20. As will be understood by those skilled in this art, air is introduced under pressure into the paint spray booth 20 from a duct located above the paint spray booth, such that the air circulates through the paint spray booth 20 into the collection system 26 as shown by arrows 28. Grating 30 is normally provided on opposed sides of the conveyor system 24, which serve as the floor of the paint spray booth, and air circulates through the grating. In this embodiment of the invention, the conveyor system 24 also includes a center grates 32 between the conveyor units, as described further below, such that the air circulates between the conveyor units into the powder paint collection system 26.

The powder paint collection system 26 of this invention includes two powder paint collectors 34, each having an outlet 36, and filters 38 are provided above the collectors. The collector system 26 of this invention also includes a V-shaped baffle 40 having an apex located between the conveyor units which directs the excess powder paint received between the conveyor units of the conveyor system 24 to the collectors 34 as discussed further below. Air return ducts 42 are normally provided, as shown.

Figure 2:
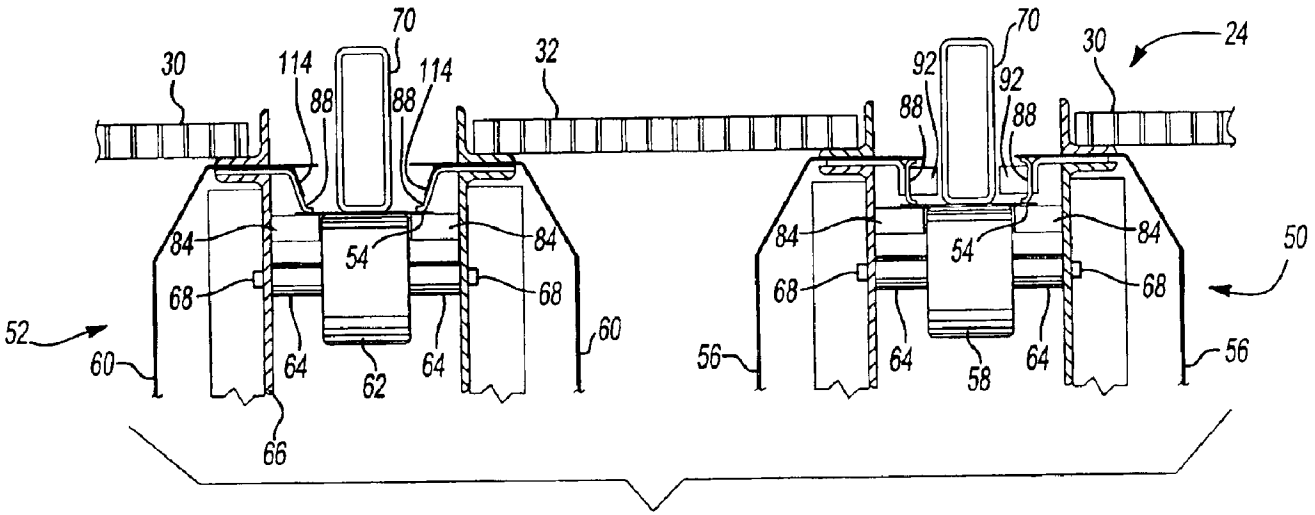
FIG. 2 is an enlarged view of the conveyor system illustrated in FIG. 1.

FIG. 2 illustrates the upper portion of the conveyor system 24 shown in FIG. 1. As shown in more detail in FIG. 2, the conveyor system 24 includes two spaced conveyor units, including a first conveyor unit 50, sometimes referred to as the skid conveyor guide unit, and a second conveyor unit 52, sometimes referred to as the follower conveyor unit. The spaced conveyor units 50 and 52 each include a continuous belt, preferably a stainless steel belt as discussed further below. The skid guide conveyor unit 50 includes a first sealed housing or shroud 56 having a plurality of spaced rollers 58 shown in more detail in FIG. 3, and the follower conveyor unit 52 includes a second sealed housing or shroud 60 having spaced rollers 62. The rollers are rotatably supported on roller shafts 64 which are supported on the frame assembly 66 by bolts 68. The continuous stainless steel belts 54 receive the skids 70 of the frame which carries the part to be painted, such as the automatic body 22 shown in FIG. 1.

Figure 4:
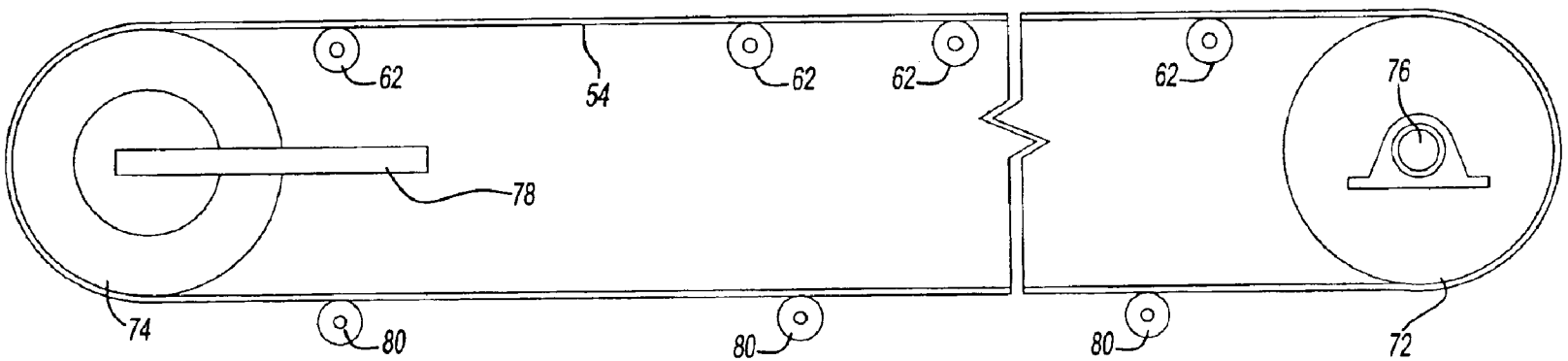
FIG. 4 is a side partially schematic crosssectional view of the conveyor system illustrated in FIGS. 1 to 3.

FIG. 4 illustrates a suitable drive for the belts 54 of the conveyor system 24 of this invention. The continuous belt 54 is received around opposed drums or wheels, including a drive drum 72 and a tensioning drum 74. The drive drum is received on a driven shaft 76 and the tensioning drum 74 includes a tensioning element 78. As will be understood by those skilled in this art, the tensioning element 78 includes a heavy coil spring or the like which tensions the continuous belt 54 around the drive drum 72. The support rollers 62, which may include a polymeric coating, such as rubber or synthetic rubber, support the belt 52. The lower rollers 80 simply guide the continuous belt 54 and may therefore be conventional rollers as described further below. In a typical application, wherein the travel of the skid in the powder paint spray booth is between fifty and one hundred feet, for example, the rollers 62 may be spaced apart about three feet and the lower rollers 80, which prevent sagging of the belt 54, may be spaced about ten feet.

Figure 3:
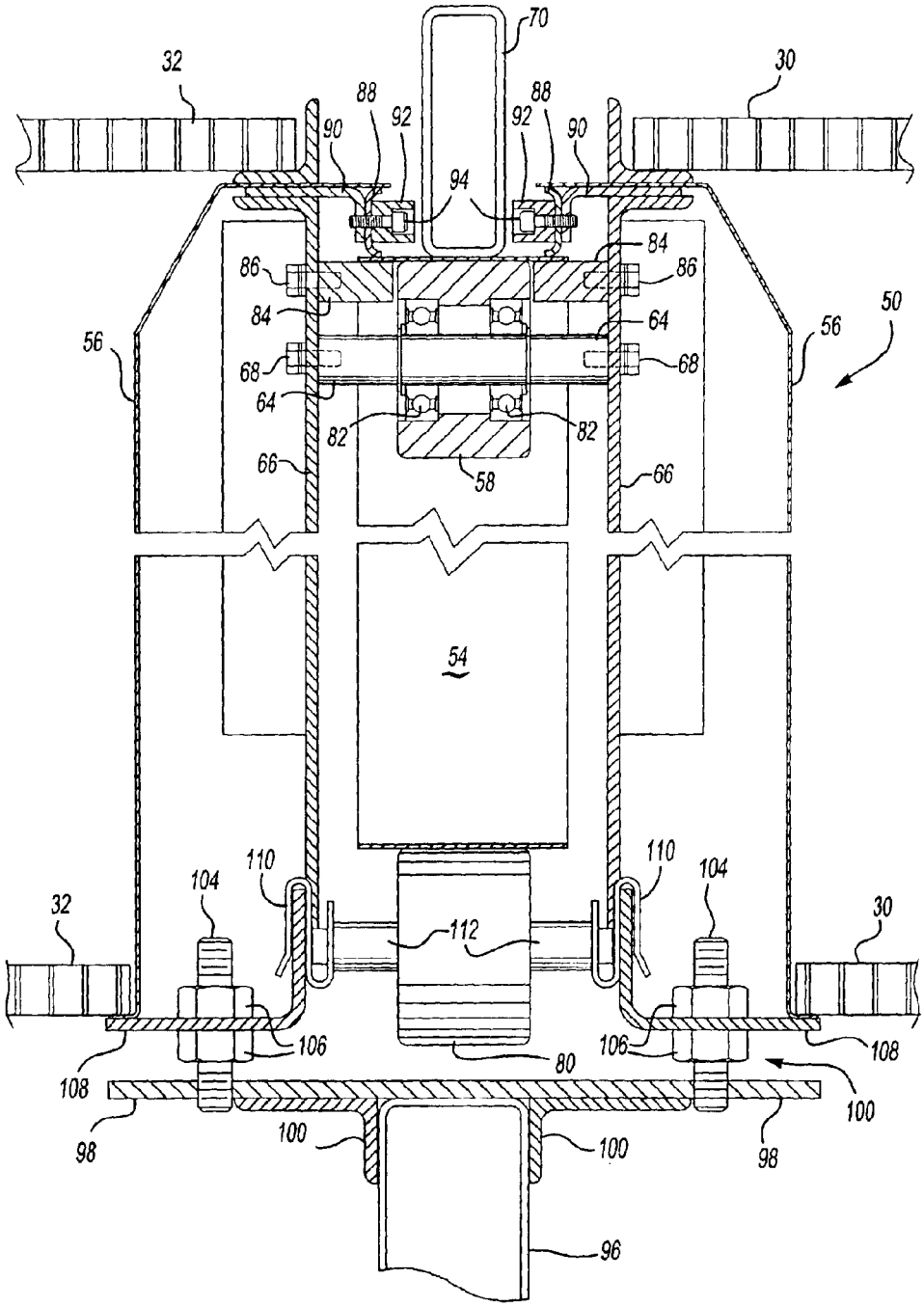
FIG. 3 is an enlarged crosssectional view of one of the conveyor units shown in FIG. 2.

FIG. 3 illustrates in more detail the skid guide conveyor unit 50. As shown, the rollers 58 include suitable caged ball bearings 82 as is conventional for rollers of this type. In this embodiment, the assembly includes spacer bars 84, which are retained to the frame assembly 66 by bolts 86, supports the belt 54 in FIG. 2 in the case of a bent or warped skid 70. The assembly further includes polymeric sealing members 88 which are attached to angle members 90 by guide members 92 attached to the frame assembly 66 by bolts 94. The housing or shroud 56 is thus sealed by the sealing members 88 which engage the lateral edges of the continuous stainless steel belts 54, preventing entry of powder paint into the sealed housings 56 and permitting the use of conventional rollers 58 and 80. The frame assembly 66 may be supported in the powder paint spray booth by any conventional means. In this embodiment, the frame assembly is supported by truss members 96, which support the support plate 98 and may be secured to the trusses by angle members 100 which may be welded to the truss members 96 and the support plate 98. The assembly further includes leveling lugs 102 which comprise male threaded studs 104 and lock nuts 106, such that the frame assembly may be accurately leveled following assembly. The frame assembly is then supported on angle members and weld clips support the main frame assembly 66 and the roller shaft 112 of the lower rollers 80, as shown. The second conveyor unit or follower conveyor unit 52 may be identical to the skid guide conveyor unit 50, except that the guide members 92 have been eliminated. In this embodiment, stainless steel seal guide members 114 are provided to retain the sealing members 88 against the lateral or peripheral edges of the belts 54 as shown in FIG. 2. As will be understood by those skilled in this art, however, it is also possible to guide the skids 70 on the belts 54 by providing a guide member 92 on each assembly, such as locating a guide member on either the inside or the outside of the skid 70. The seals 88 may be formed of any suitable material, but are preferably formed of a polymeric material having a relatively low coefficient of friction, such as Teflon®.

Having described one preferred embodiment of the conveyor system 24 of this invention, it will be understood that the conveyor system of this convention provides several advantages over the prior art. First, the conveyor system of this invention reduces the overall cost of prior conveyor systems for powder paint spray booths. Because the housings or shrouds 56 and 60 are sealed, conventional rollers and bearings may be utilized. Second, the cost of two relatively narrow stainless steel belts is significantly less than the cost of a conventional stainless steel belt having a sufficient width for receipt of both sides of the skid 70. As set forth above, a prior art system utilizes a stainless steel belt having a width of about a yard, which is easily damaged and prevents personnel from walking over the conveyor system. The conveyor system of this invention includes side and center grating 30 and 32 which permit a worker to step on the center grate and over the conveyor system. Further, because the stainless steel belts 54 are relatively narrow and the peripheral edges are sealed by sealing members 88, accumulation of powder paint on the stainless steel belts is significantly reduced, particularly compared to the wider belt described above. The parallel belts 54 may have a width of between five and seven inches, preferably less than ten inches and a thickness of about 1 mm. Finally, the conveyor system of this invention improves collection efficiency of excess powder paint by improving the circulation through the powder paint spray booth 20 to the powder paint collection system 26. This is because the air is free to flow through the center grates 32 between the first and second conveyor units 50 and 52, as shown by the arrows 28 in FIG. 1. Because significantly less powder paint is collected on the relatively narrow continuous stainless steel belts 54 than a single wide belt, less powder paint must be collected from the belts, and less powder paint is wasted due to contaminants.

The components of the conveyor system 24 described above may be formed of various materials. In a preferred embodiment, the sealed housings or shrouds 56 and 60 may be formed of stainless steel to reduce collection of powder paint. The frame assembly members 66 may include intermediate spacers (not shown) and the lower rollers 80 may be replaced with blocks which may be formed of plastic. The grating 30 and 32 may be conventional and is preferably supported on the frame assembly, as shown. Other details of the conveyor and collection system of this invention will be understood by those skilled in this art.

Further, various modifications may be made to the conveyor and powder paint collection system and method of this invention within the purview of the appended claims. As will be understood from the above description, the method of collecting powder paint from a powder paint application booth of this invention includes applying powder paint to a part conveyed through the powder paint application booth by the conveyor as described above which includes directing air between the conveyor housings, thereby directing at least a portion of the excess powder paint between the housings and into the powder paint collector. In the preferred embodiment, the conveyors include a grate supported on opposed sides of the housings thereby permitting air under pressure to pass through the grating and into the collection system, as described. Although a stainless steel belt is preferred, the belt may also be formed of a mild steel, such as Teflon®. Having described a preferred embodiment of the conveyor and powder paint collection system and method of this invention, the invention is now claimed as follows.

What is claimed is:

1. A conveyor and powder paint collection system, including a powder paint application booth having a conveyor conveying parts to be painted through said powder paint booth and a powder paint collection system located below said powder paint application booth, said conveyor and powder paint collection system comprising:

spaced continuous parallel first and second moving belts located within said powder paint booth, said first continuous belt supported by a plurality of spaced first rollers and said second continuous belt supported by plurality of spaced second rollers, a first housing enclosing said plurality of spaced first rollers in sealed relation, and a second housing spaced from said first housing enclosing said plurality of spaced second rollers in sealed relation; and a powder paint collector receiving excess powder paint from said powder paint booth including excess powder paint received between said first and second housings.

2. The conveyor and powder paint collection system as defined in claim 1, wherein said spaced continuous parallel first and second belts are each formed of stainless steel.

3. The conveyor and powder paint collection system as defined in claim 1, wherein said powder paint booth includes grating between said first and second housings supported by said housings.

4. The conveyor and powder paint collection system as defined in claim 1, wherein said powder paint collection system includes two powder paint collectors located on opposed sides of said first and second housings beneath said powder paint booth and a baffle directing excess powder paint received between said first and second housings to one of said powder paint collectors.

5. The conveyor and powder paint collection system as defined in claim 4, wherein said baffle is V-shaped having an apex located generally between and adjacent said first and second housings.

6. The conveyor and powder paint collection system as defined in claim 1, wherein said first and second housings each include spaced sealing elements engaging opposed lateral edges of said spaced continuous parallel first and second belts.

7. The conveyor and powder paint collection system as defined in claim 1, wherein each of said first and second belts have a width of less than ten inches.

8. A conveyor for conveying parts to be painted through a powder paint booth wherein powder paint is applied to said parts, said conveyor comprising:

spaced continuous parallel moving first and second stainless steel belts, said first stainless steel belt supported by a plurality of spaced first rollers and said second stainless steel belt supported by a plurality of spaced second rollers, a first housing enclosing said first rollers in sealed relation and a second housing spaced from said first housing enclosing said second rollers in sealed relation.

9. The conveyor for conveying parts through a powder paint booth as defined in claim 8, wherein said conveyor includes grating located between and supported by said first and second housings.

10. The conveyor for conveying parts through a powder paint booth as defined in claim 8, wherein said first and second stainless steel belts each have a width of less than ten inches.

* * * * *